United States Patent [19]

Wendt

[11] 4,444,396

[45] Apr. 24, 1984

[54] WEIGHTED GOLF SWING EXERCISE CLUB

[76] Inventor: William P. Wendt, 712 S. Oak Ave., Marshfield, Wis. 54449

[21] Appl. No.: 410,056

[22] Filed: Aug. 20, 1982

[51] Int. Cl.[3] ..... A63B 69/36

[52] U.S. Cl. ..... 273/193 A; 272/124

[58] Field of Search ..... 273/171, 193 A, 194 R, 273/194 A, 194 B, 186 C, 183 D; 272/117, 124, 122, 123

[56] References Cited

U.S. PATENT DOCUMENTS

| | | | |
|---|---|---|---|
| 1,167,387 | 1/1916 | Daniel | 273/171 |
| 1,930,342 | 10/1933 | Graham | 273/193 A |
| 3,351,346 | 11/1967 | Strahan | 273/193 A |
| 3,414,260 | 12/1968 | Gust | 273/193 A X |
| 3,743,297 | 7/1973 | Dennis | 273/193 A |
| 4,316,609 | 2/1982 | Silberman | 272/117 |

OTHER PUBLICATIONS

"Golf Magazine", Nov. 1976, p. 117.

*Primary Examiner*—George J. Marlo
*Attorney, Agent, or Firm*—Michael, Best & Friedrich

[57] ABSTRACT

An exercise device for improving a golf swing comprising a grip on an upper end of a shaft, a series of perforated circular discs weighing 1, 2, 4, 8 and 16 ounces, respectively, adapted to fit securely on the shaft, progressing geometrically in weight and a system for releasably securing any combination of the perforated discs on a lower end of the shaft. The system includes a lower base plate on the shaft secured against axial movement toward the lower end of the shaft and an upper collar releasably secured on the shaft. The base plate has a configuration so that the discs are secured on the shaft between the collar and the base plate.

5 Claims, 5 Drawing Figures

WEIGHTED GOLF SWING EXERCISE CLUB

BACKGROUND OF THE INVENTION

This invention relates to weighted clubs used for exercising the muscles used in swinging a golf club and, more particularly, to the configuration of such weighted golf clubs.

Weighted golf swing exercise devices of various styles and configurations have been devised and disclosed by others in this field of endeavor, as indicated by the attached prior art statement. These devices have not provided a golf swing exercise club with the features and advantages of this invention.

SUMMARY OF THE INVENTION

A principal object of the invention is to provide a weighted golf swing exercise club which permits one to gradually increase the weight of the exercise club so as to gradually increase the strength, stamina and suppleness of the muscles of a golfer so as to enable him to play golf to the best of his ability.

Another object of this invention is to provide such a golf swing exercise club which can be used in combination with a sophisticated and precisely defined exercise program offering the incentive of progressive muscle building and the discipline of a complete well-structured exercise regime.

Another object of this invention is to provide such a weighted golf swing exercise club which utilizes a minimum number of weights while providing a maximum number of incremental weight changes. The club also provides a convenient and safe means of securing the weights on the club at a minimum amount of cost.

Another object of this invention is to provide such a weighted golf swing exercise club which has the length and arc of a standard size club.

For the achievement of the above and other objectives, this invention provides an exercise device for improving a golf swing comprising a grip on an upper end of a shaft, a series of perforated circular discs adapted to fit securely on the shaft, progressing geometrically in weight, and a means for releasably securing any combination of the perforated discs on a lower end of the shaft. In one embodiment, the means includes a lower base plate on the shaft secured against axial movement toward the lower end of the shaft, and an upper collar releasably secured on the shaft. The base plate has a configuration so that the discs are secured on the shaft between the collar and the base plate. The perforated discs progress geometrically in weight from one ounce to sixteen ounces.

In one embodiment of the invention, the means for releasably securing any combination of the discs on the lower end of the shaft comprises a pin releasably secured in a bore in a side of the lower end of the shaft, a perforated base plate adjacent the pin and on the shaft, and a collar releasably secured on the shaft with the series of perforated discs disposed between the collar and the base plate.

In one embodiment of this invention, the lower end of the shaft includes a cylindrical portion with a diameter generally equal to the widest portion of the grip, and a base plate comprising a flange extending radially outwardly from the lower end of the shaft. The discs are disposed on the cylindrical portion between the collar and the flange.

DESCRIPTION OF THE PREFERRED EMBODIMENT

Figure 1:
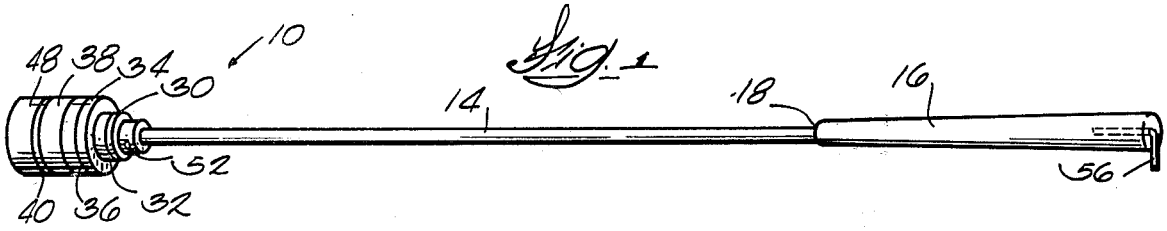
FIG. 1 is a perspective view of one embodiment of the invention.
Figure 2:
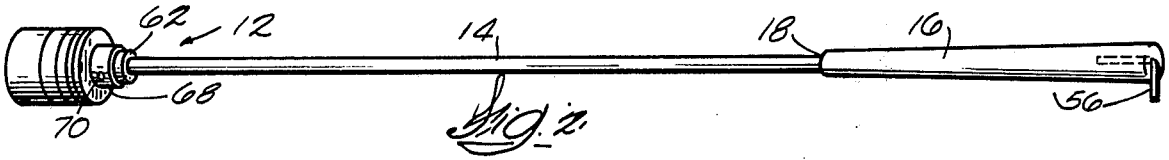
FIG. 2 is a perspective view of another embodiment of the invention.
Figure 3:
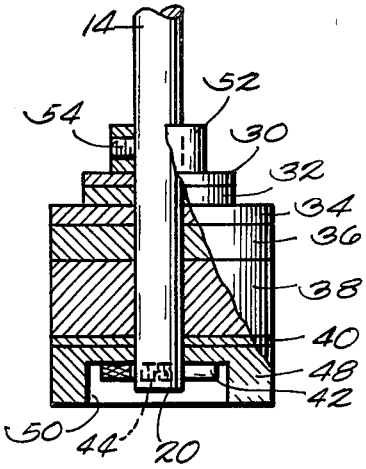
FIG. 3 is a side view partially in section of one end of the exercise device shown in FIG. 1.
Figure 5:
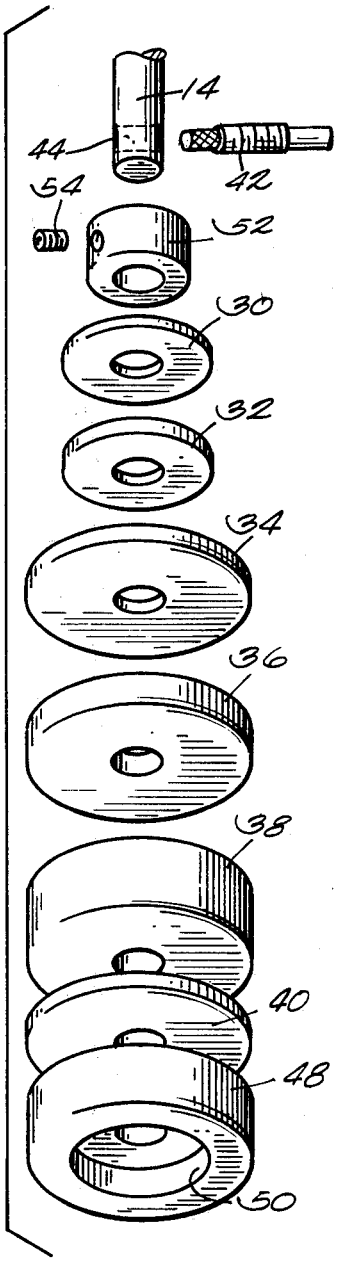
FIG. 5 is an exploded perspective view of the end of the device shown in FIG. 3.
Figure 4:
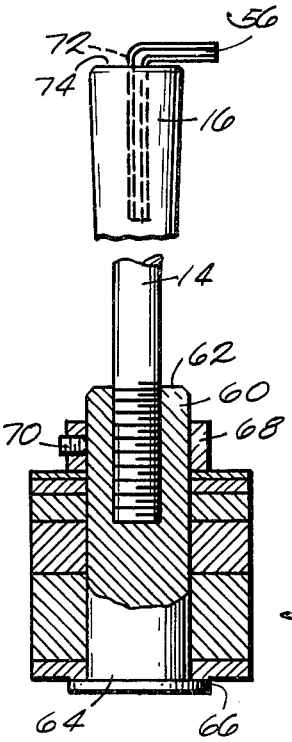
FIG. 4 is a side view partially in section of one end of the exercise device shown in FIG. 2.

One preferred embodiment 10 of this invention is shown in FIGS. 1, 3 and 5. An alternate preferred embodiment 12 is illustrated in FIGS. 2 and 4.

Both embodiments preferably include a regulation length shaft 14 (with a length comparable to a five or six iron) including a conventional grip 16 attached to one end 18. The shaft is strong enough to support considerable weight. For example, it can be a one half inch steel rod. Because the weighted golf swing exercise device includes a regulation length shaft 14, exercising with the club provides the arc of a regulation golf club and concentrates the weight of the club in the normal golf club hitting area. When the device must be used indoors in a room with a low ceiling, a shorter shaft can be used. The shorter shaft is not preferred, however, for the above reason.

On the other end 20 of the shaft 14 are a series of five perforated circular discs (30, 32, 34, 36 and 38) releasably secured between means for holding any combination of the discs on the shaft 14.

The discs increase geometrically in weight from one ounce to sixteen ounces. In other words, as shown in FIG. 5, disc 30 weighs one ounce, disc 32 weights two ounces, disc 34 weighs four ounces, disc 36 weighs eight ounces, and disc 38 weighs sixteen ounces. These five discs permit thirty-one separate combinations of discs ranging in weight from one ounce to one pound and fifteen ounces by one ounce increments. For illustration purposes, ten ounces of weight can be achieved by using a combination of disc 36 and disc 32. Eleven ounces of weight can be achieved by using disc 36, 32 and 30. Twelve ounces of weight can be achieved by using a combination of disc 36 and 34, and so on. Thus, by using these five perforated discs, the golf exercise club can be increased incrementally in weight by one ounce increments to permit a golfer to gradually increase the weight of the weighted golf exercise club as the golfer's proficiency with each weight level increases. The club thus provides a means of progressively increasing its weight so as to gradually strengthen the muscles used by a golfer. Since the club is much heavier than a regulation golf club, however, the club should not be used as a warm-up means, but should be used for exercise and then followed by a resting period before golfing.

Each of the perforated discs are chrome plated to provide a more attractive appearance. The five chrome plated discs which provide for a progression in weight by one ounce increments, is the minimum number of discs capable of providing thirty-one separate progressions. While having this capability of providing a large number of progressions, the small number of discs minimize production costs.

An additional one ounce perforated circular disc 40 can be used to permit the series of perforated discs to equal a total of two pounds. In the preferred embodiment, the disc 40 is made of a material lighter than the other discs, and is gold in color. In an exercise program utilizing the club to gradually strengthen the muscles used by a golfer, the large and attractive gold one ounce disc 40 can be used to begin and end the program and thus serve as an incentive to the golfer to complete the program.

In the embodiment 10 illustrated in FIGS. 1 and 3, the discs are releasably secured on the lower end 20 of the shaft 14 in the following manner. The end 20 of the shaft 14 includes a pin 42 secured in a threaded bore 44 in the side of the end 20 of the shaft 14. Adjacent the pin 42 is a perforated base plate 48 containing a recess 50 which surrounds the pin 42. The base plate 48 is circular with an outer diameter greater than the diameter of the perforations in the discs. This configuration thus holds the discs on the shaft 12. The pin 42 serves to fix the base plate 48 on the shaft 14 so the base plate 48 will not slide off the lower end 20 of the shaft 14. A collar is releasably secured on the shaft 14 by use of a set screw 54, and a desired combination of perforated discs are positioned between the base plate 48 and the collar 52.

To release the securing means, the set screw 54 in the collar 52 is unscrewed by use of an allen wrench 56, and then moved along the shaft 14 until the perforated discs and the base plate 48 can be moved along the shaft 14 so that the recess 50 no longer surrounds the pin 42. The pin 42 is then unscrewed from the bore 44 in the end 20 of the shaft 14, and the base plate 48 and the desired discs are removed. A new combination of discs can then be placed on the shaft 14, the base plate 48 again positioned on the shaft 14 and the pin 42 secured in the threaded bore 44. The collar 52 is then tightened down against the perforated discs so they are lodged between the base plate 48 and the collar 52.

In the embodiment illustrated in FIGS. 2 and 4, the shaft 14 includes a cylinder 60 with two ends 62 and 64 with one end 62 threaded or attached by other similar means to the other end 20 of the shaft 12. The cylinder 60 has a diameter generally equal to the widest portion of the grip 16. The means for releasably securing any combination of perforated discs on the shaft 12 in this embodiment includes a radially outwardly extending flange 66 on the free or lower end 64 of the cylinder 60, and a collar 68 releasably secured on the cylinder 60 by a set screw 70. The cylinder 60 including the flange 66 may be cut on a lathe or constructed using other conventional means. The cylinder 60 can also be formed as an integral portion of the shaft 12.

To put a new combination of perforated discs on the exercise device 12, the set screw 70 in the collar 68 is unscrewed using the allen wrench 56 and then removed by sliding the collar 68 over the shaft 14 and over the grip 16 on the end 18 of the shaft 14. The perforated discs are then removed by sliding them over the shaft 14 and the grip 16, and a new combination of discs are then placed on the shaft 14 by moving them over the grip 16 and along the shaft 14 to a point adjacent the flange or base plate 66. After the new combination of discs are placed on the cylinder 60, the collar 68 is then moved over the grip 16 and shaft 14 and secured by the set screw 70 so that the new combination of perforated discs are lodged between the flange 66 and the collar 68.

Both the base plate or flange 66 on the exercise device 12, and the base plate 48 with the recess 50 surrounding or enclosing the pin 42 on the exercise device 10, provide a weighted golf swing exercise device with a lower end which is free from projections which might catch or grab grass, carpet or other matter which the club may come in contact with when the golfer is swinging the exercise club.

A hole 72 is provided in the end 74 of the grip 16 for snugly receiving and storing the allen wrench 56 when it is not needed.

The weighted exercise club provided by the invention has several advantages. It trains one to take the club back low, slow and in one piece. "Hitting from the top" becomes quite unnatural because the lower body, not the hands, takes over on the downswing. The correct swing is the most natural and the easiest way to swing the club. Swinging the weighted exercise club exercises the left hand of right-hand golfers more than the right hand. This builds up the strength in the left hand so that it is more on par with the naturally stronger right hand, resulting in greater control. Golfers residing in cold winter areas can train throughout the year and be in September shape in April. As the weight is increased progressively, the golfer's body becomes stronger which reduces the chance of an injury. As the golfer's strength and power increases, his confidence also increases and he becomes mentally prepared to play golf to the peak of his ability. Swinging the weighted exercise club is a great aid in building a grooved swing. By concentrating on his swing while using the weighted exercise club, the golfer can concentrate more on his game and shots, forget about his swing, while playing golf.

It is to be understood that the invention is not confined to the particular construction and arrangement of parts herein illustrated and described but embraces all such modified forms thereof as come within the scope of the following claims.

I claim:

1. An exercising device for improving a golf swing comprising a shaft with an upper end and a lower end, a grip on said upper end of said shaft, a series of circular discs including perforations receiving said shaft, said discs progressing geometrically in weight from one ounce to sixteen ounces, means for releasably securing any combination of said discs on said lower end of said shaft, said lower end of said shaft being a cylindrical portion with a diameter generally equal to the widest portion of said grip, said means for releasably securing said discs on said shaft comprising an upper collar releasably secured on said cylindrical portion and a flange extending radially outwardly from a lower end of said cylindrical portion.

2. An exercising device according to claim 1 wherein said collar is releasably secured by a set screw in the side of said collar, and said device further includes a hole in the end of said grip on said shaft for snugly receiving an allen wrench for turning said set screw in said collar.

3. An exercising device according to claim 1 wherein said series of perforated circular discs comprises five discs progressing geometrically in weight from one ounce to sixteen ounces.

4. An exercising device according to claim 3 and further including another one ounce perforated circular disc adjacent said series of perforated discs.

5. An exercising device for improving a golf swing in accordance with claim 1 wherein said series of circular discs comprise a first disc weighing one ounce, a second disc weighing two ounces, a third disc weighing four ounces, a fourth disc weighing eight ounces, and a fifth disc weighing sixteen ounces.

* * * * *